US012352150B2

(12) United States Patent
Nolen et al.

(10) Patent No.: US 12,352,150 B2
(45) Date of Patent: Jul. 8, 2025

(54) HELICAL FLOW GAS SEPARATOR

(71) Applicant: WellWorx Energy Solutions LLC, Midland, TX (US)

(72) Inventors: Kenneth B. Nolen, Midland, TX (US); John M. Raglin, Midland, TX (US); Justin R. Ramirez, Midland, TX (US); Steven R. Hinojos, Midland, TX (US)

(73) Assignee: Liberty Lift Solutions LLC, Houston, TX (US)

( * ) Notice: Subject to any disclaimer, the term of this patent is extended or adjusted under 35 U.S.C. 154(b) by 0 days.

(21) Appl. No.: 18/215,001

(22) Filed: Jun. 27, 2023

(65) Prior Publication Data

US 2025/0003324 A1 Jan. 2, 2025

(51) Int. Cl.
*E21B 43/38* (2006.01)
*E21B 43/12* (2006.01)

(52) U.S. Cl.
CPC ..... *E21B 43/38* (2013.01); *E21B 43/121* (2013.01)

(58) Field of Classification Search
CPC ..... E21B 43/38; E21B 43/121
See application file for complete search history.

(56) References Cited

U.S. PATENT DOCUMENTS 1,279,758 A * 9/1918 Putnam ..... E21B 43/38 96/214
1,362,775 A * 12/1920 Bunker ..... E21B 37/00 166/107
1,628,900 A * 5/1927 Neilsen ..... E21B 43/38 96/214
2,800,085 A * 7/1957 Hansen ..... E21B 43/38 417/199.2
2,838,178 A * 6/1958 Bankes ..... E21B 43/38 366/339
3,048,122 A * 8/1962 Hansen ..... E21B 43/38 166/105.5
6,322,616 B1 * 11/2001 Kennedy ..... E21B 43/38 96/208
6,394,182 B1 * 5/2002 Fadel ..... E21B 43/38 166/265
2012/0097038 A1 * 4/2012 Hill ..... B01D 19/0042 96/216
2015/0144328 A1 * 5/2015 Botts ..... B01D 19/0052 166/227
2015/0233228 A1 * 8/2015 Roth ..... E21B 43/122 166/372

* cited by examiner

*Primary Examiner* — James G Sayre
(74) *Attorney, Agent, or Firm* — Bell Nunnally & Martin LLP

(57) ABSTRACT

A separator in a wellbore for separating liquid and gas in a petroleum production stream is described. The separator is formed by an outer tube defining an outer conduit extending from a lower end to an upper end of the outer tube. An inner tube is positioned concentrically within the outer tube, wherein the inner tube defines an inner conduit extending from a lower end to an upper end of the inner tube. The inner conduit includes a cap at its lower end and a plurality of openings connecting the outer conduit and the inner conduit. A helical auger extends between the inner tube and the outer tube, the helical auger defining a pathway between the outer tube and the inner tube such that the gas in the production stream passes through the openings in the inner tube while the fluid passes through the outer conduit to a pump.

14 Claims, 6 Drawing Sheets

HELICAL FLOW GAS SEPARATOR

TECHNICAL FIELD

The present disclosure is directed to an apparatus and method for petroleum producing wells and more particularly to the separation of gas and liquid from a hydrocarbon production stream.

BACKGROUND OF THE INVENTION

Petroleum wells can be naturally flowing, injecting or can be produced by any means of artificial lift. Such artificial lift in a production well may be produced by, but is not limited to, an electrical submersible pump (ESP), a sucker rod pump, downhole hydraulic pump, and/or a progressing cavity pump. For instance, an ESP system may include an electric motor and a pump that is used to pump oil, water, or other liquids within a wellbore. The electric motor may have a rotatable rotor that is contained in a stationary stator. When the motor operates, the rotor may rotate to provide artificial lift within the wellbore.

Referring to FIG. 1, a diagram of a typical ESP system (100) includes a centrifugal pump (101), a pump motor (105), and a seal assembly (103) located between the pump (101) and motor (105). The pump (101), seal assembly (103), and motor (105) are located within a borehole (121), inside a standard well casing (123). The ESP system (100) further includes a variable speed drive (111), a controller (113), and an optional transformer (115) located on the surface (125). A three-phase power cable (117) provides power and communications between the variable speed drive (111) (or optional transformer (115)) and the pump motor (105). The variable speed drive (111) can operate as a power source by providing electrical power for driving the motor (105). The cable (117) typically extends thousands of feet and thereby introduces significant electrical impedance between the variable speed drive (111) (or optional transformer (115)) and the pump motor (105). By altering the output voltage and frequency of the variable speed drive (111), the controller (113) associated with the variable speed drive (111) controls the voltage at motor (105) terminals, and thus the operation of the pump.

As can be seen from FIG. 1, where the product flowing into the well bore contains entrained and free gas, that gas can enter the pump and reduce the volumetric efficiency of the pump. For instance, the hydrocarbon production stream can include both liquid and gaseous products that are a natural byproduct of the producing wells. As hydrocarbons and water flow through the formation, gases can travel in the flow stream either separate from the liquid products or dissolved within the liquid products. The gases are pumped into the production tubing and can cause problems for an artificial lifting mechanism, such as ESP systems or rod pumped wells, by reducing the volumetric efficiency of the pump.

Gas interference occurs in situations when the pump is filling with a considerable amount of free gas that is not separated before entering the pump. If the amount of free gas entering the pump can be reduced, the volumetric efficiency of the pump can be improved, and production (oil, water and gas) can be increased. Also, downhole pumping equipment life is typically extended.

BRIEF SUMMARY OF THE INVENTION

In a preferred embodiment, a separator for use within a well bore is described. The separator includes an outer tube defining an outer conduit extending from a lower end to an upper end of the outer tube. An inner tube is positioned concentrically within the outer tube, the inner tube defining an inner conduit extending from a lower end to an upper end of the inner tube, wherein the inner conduit includes a cap at its lower end and one or more openings. An auger extends between the inner tube and the outer tube, the auger defining a pathway between the outer tube and the inner tube. The auger can be defined as a spiral shaped tool for drilling or moving items. The tool can be used and modified to separate to separate gas from liquids according to the concepts described herein.

In another preferred embodiment, a method for separating gas from fluid in a production stream in a well is described. The method includes directing the production stream into an outer tube of a separator and causing the production stream to flow through an outer conduit defined by the outer tube, an inner tube and an auger disposed between the outer tube and inner tube, the inner tube having one or more openings, adjacent to a bottom surface of the helical auger such that gas in the product stream can flow into an inner conduit in the inner tube. The method further includes directing a separated fluid of the production stream in the outer conduit to an artificial lift mechanism above the separator.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Preferred embodiments of a gas bypass separator for a hydrocarbon producing well provides mechanisms for both reducing the amount of gas entrained in a liquid product, including oil and/or water, and separating that free gas from the liquid product. The mechanism uses an auger resembling a helical screw mechanism, as described below, to separate the liquid/gas mixture. Other than gas lift, any type of artificial lift applicable to any producing hydrocarbon well may be used, such as a sucker rod pump, rod pumping, electric submersible pumps, progressing cavity, and other methods.

Figure 1:
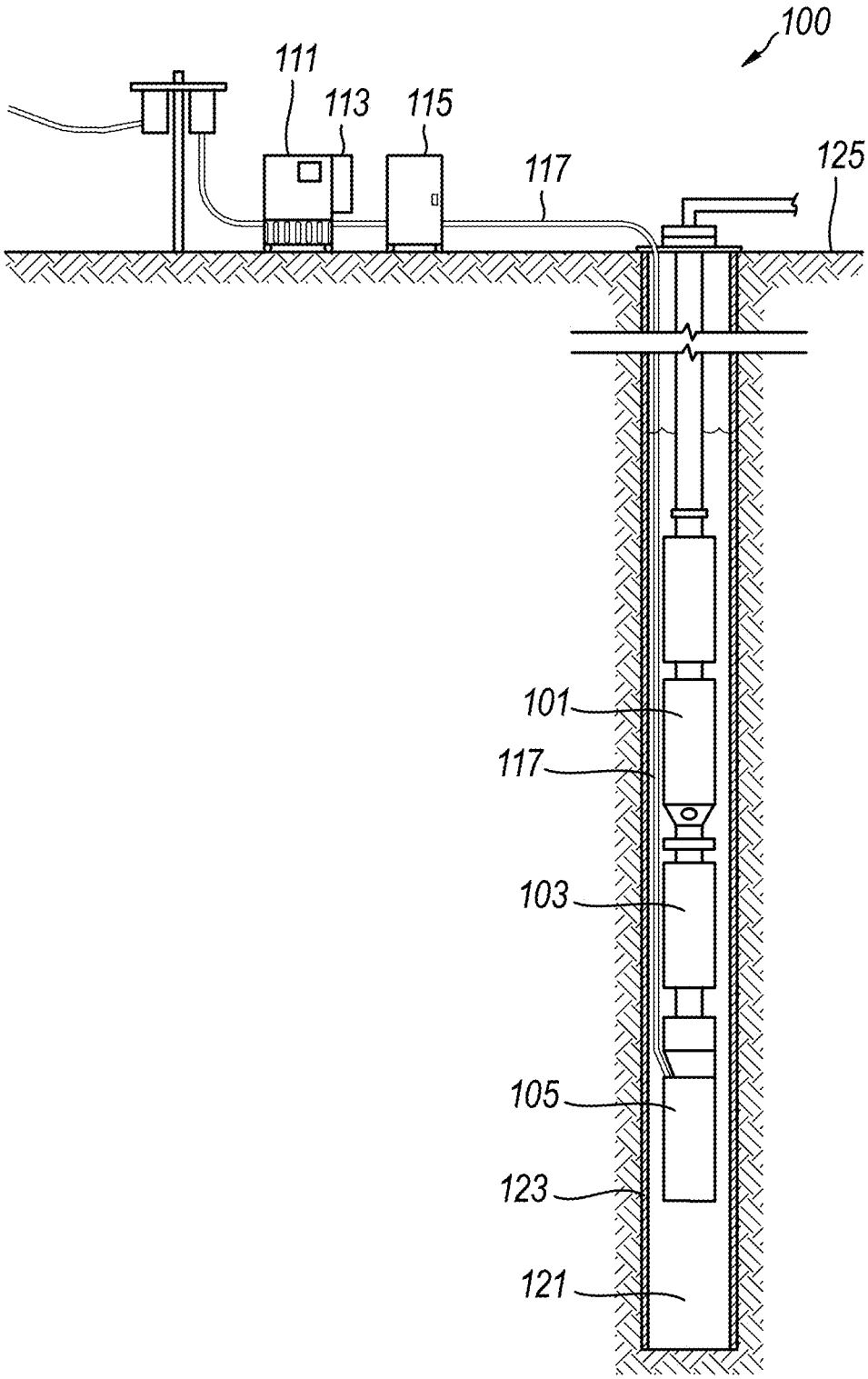
FIG. 1 (PRIOR ART)
FIG. 1 depicts a diagram of a prior art petroleum producing well showing an existing submersible pump assembly to provide artificial lift.
Figure 2:
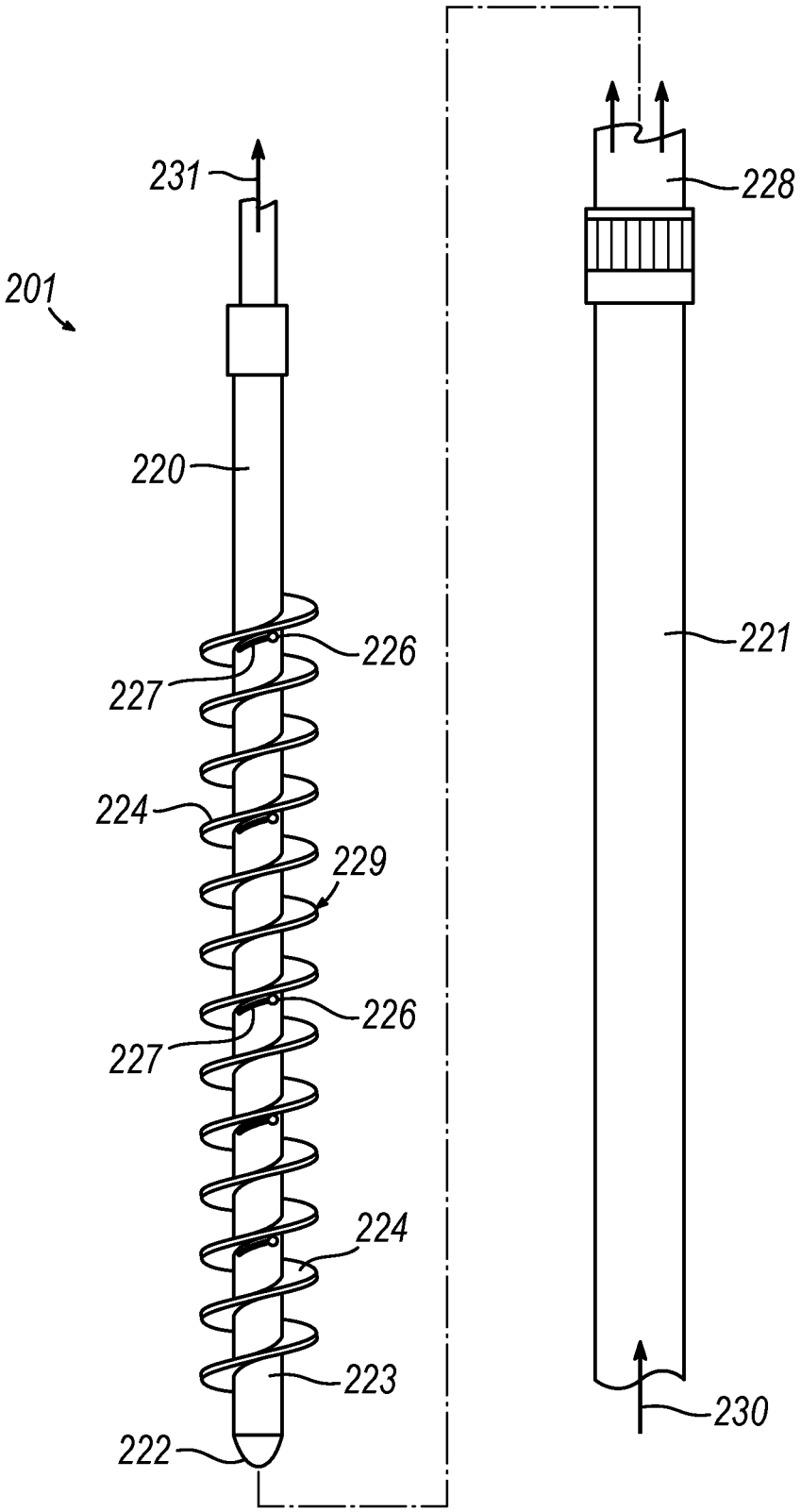
FIG. 2 depicts an exploded view of a preferred embodiment of a separator according to the concepts described herein.
Figure 3:
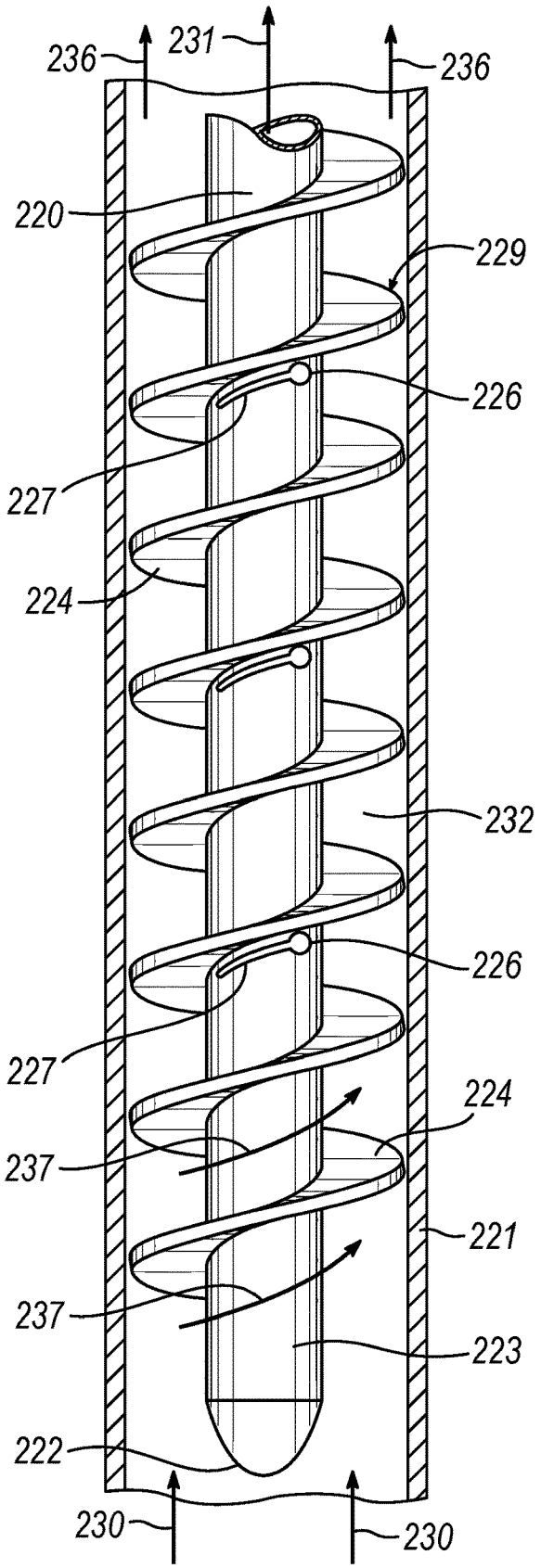
FIG. 3 depicts a cutaway view of the outer tube of the separator of FIG. 2 showing the inner tube and helical auger.

Referring now to FIGS. 2-3, a preferred embodiment of a gas separator (201) according to the concepts described herein is shown for use in a hydrocarbon producing well. Gas separator (201) is formed from an outer tube (221) and an inner tube (220). Inner tube (220) is capped (222) at a lower end (223). Auger or augers blades (224), which may also be called flights or flighting, extend in a helical shape up from the bottom end (223) and have an outer diameter equal to, or just smaller than, the inner diameter of the outer tube (221). There is preferably little to no gap between an outer edge (229) of the auger flight (224) and the inner wall of outer tube (221) but a gap or gaps may exist in practice without significantly affecting the operation of the separator (201). Holes, (226) and/or slots (227), which individually or together can be referred to as openings, provide pathways from the outside of inner tube (220) to the inside of inner tube (220) providing access to path (231) up through the inside of inner tube (220). While a combination slot (227) and hole (226) is shown, any combination of individual slots and or holes in the inner tube (220) that allows gasses to flow from the outer portion of inner tube (220) to the inside of inner tube (220) is within the scope of the concepts described herein.

As shown in FIG. 2, the inner tube (220) forming the auger is inserted into or mounted inside outer tube (221) such that the auger flighting (224) fits against the inner wall of outer tube (221). As will be discussed in greater detail with reference to FIGS. 3 and 4, this creates a circular upward pathway in the space between the inner tube (220) and the outer tube (221) following the path created by the auger flighting (224) with fluid and gas entering the bottom end (230) of outer tube (221) and out the upper end (228) of the outer tube. Gas passes from the outside of inner tube (220) to the inside of inner tube (220) through one or more holes (226) and slots (227).

Referring now to FIG. 3, a view of a preferred embodiment of the auger formed by the auger flighting (224) and inner tube (220) inside a cutaway of outer tube (221) is shown. As described with reference to FIG. 2, a mixture of liquid and gas (230) flows up the interior of outer tube (221) having entered the outer tube (221) from the wellbore at some point below. The mixture flows up and around the auger and inner tube (220) directed by auger flighting (224) through the conduit (232) formed between the inner tube (220) and the outer tube (221). The change in direction and the centrifugal force applied to the fluid as a result of the motion causes the gas and liquid to begin separating inside the conduit between the outer tube (221) and the inner tube (220) of the auger. Passages, such as holes (226) and/or slots (227), are preferably positioned adjacent to an underside of section of auger flighting (224) and provide a path for the gas to flow from outside the inner tube to inside the inner tube (220). Once inside the inner tube (220) the gas continues to flow up the inner tube where it can be directed into the casing (shown with reference to FIG. 5) or through an inner tube to the surface. Gas free liquid (236) flows up the space between the inner tube (220) and outer tube (221) to an ESP, rod, or other type of pump.

Figure 4:
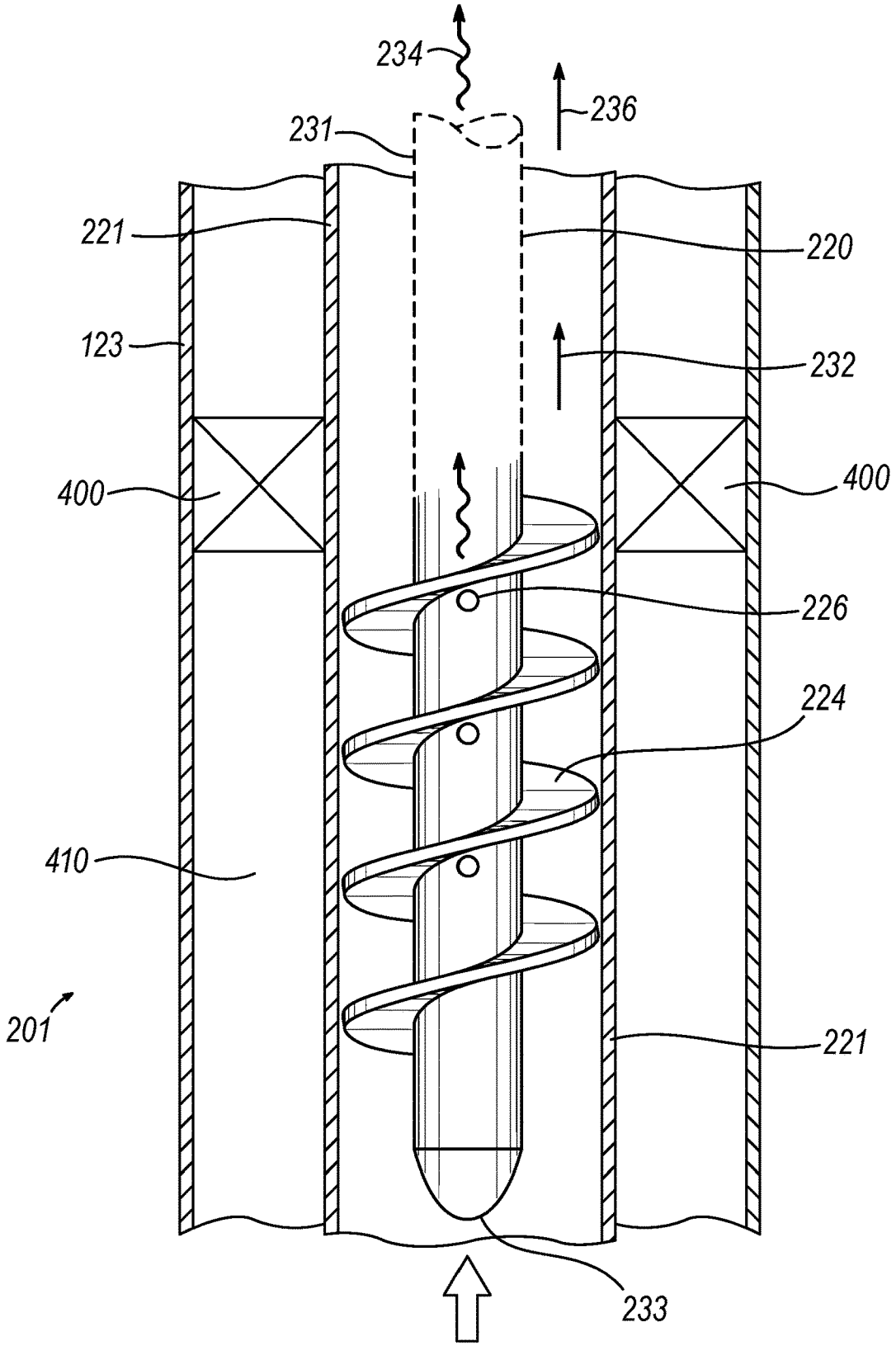
FIG. 4 depicts a perspective view of an exemplary embodiment of a gas separator for use within a petroleum producing well.

Referring now to FIG. 4, in preferred embodiments, the separator (201) may be positioned within a well casing (123) below an artificial lift, such as an ESP system, as described to separate gas within the wellbore before the gas reaches the artificial lift. As shown in FIG. 2, the separator (201) comprises an auger formed by an inner tube (220) with auger flighting (224) and an outer tube (221) positioned around the auger. The space between the outer tube (221) and the inner tube (220) defines a conduit (232) extending longitudinally. The outer and inner tube (221, 220) each have a generally cylindrical body, but any other suitable shapes may be used (e.g., square, hexagonal, octagonal, etc.). The outer tube (221) preferably has a larger length than the inner tube (220) such that the inner tube (220) ends before a bottom end of the inner tube (220) at a closed bottom end (233). For instance, the outer tube (221) may have a length of about 3 feet and an outer diameter of about 4 inches, though other suitable dimensions may be used to correspond to the diameter of the wellbore and the preferred length of tool. The inner tube (220) may have a corresponding length of about 3 feet and an outer diameter of about 2⅜ inches, though any other suitable dimensions may be used. The closed bottom end (233) of the inner tube (220) may be plugged with a cap or otherwise sealed to prevent the gassy fluid from entering the bottom of inner tube (220). Small openings may be formed around the edges of the bottom end of inner tube (220) to allow any fluid that may enter the inner tube to drain back into the outer tube (221). Free gas (234) flows through holes (226) and up the inside of inner tube (221) and is then directed into the annulus where it flows to the surface. Gas free liquid (236) flows up path (232) and is directed to the inlet of the artificial lift system where it is pumped to the surface. Separator (201) can be attached via a coupler to other pipes or tools as preferred. Packer assembly (400) closes off wellbore (410) to force all of the liquid and gas mixture up through the bottom end of outer tube (221). Packers (400) seal the wellbore (410) preventing liquid and gas from rising up the wellbore.

Figure 5:
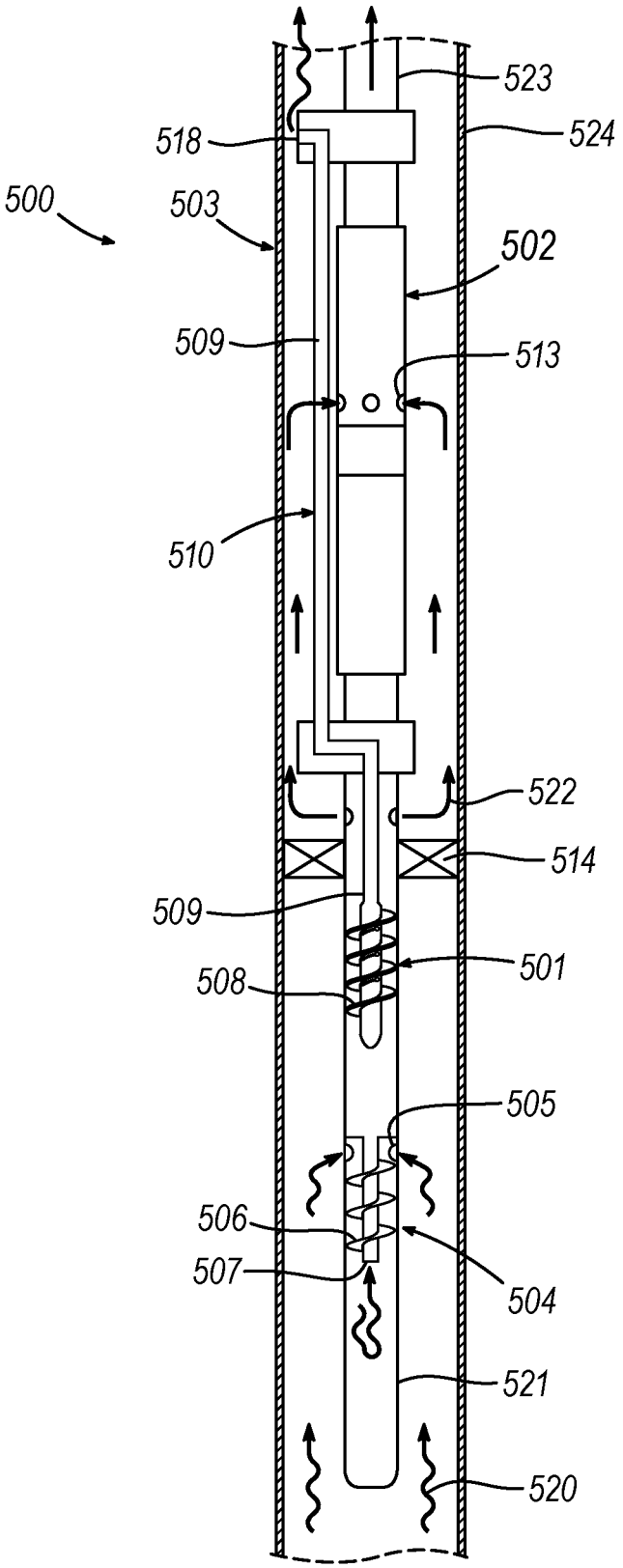
FIG. 5 depicts a side view of an exemplary well-string arrangement in a well-bore employing a submersible pump system.

Referring now to FIG. 5, an example of separator in a well environment according to the concepts described herein is shown. The configuration of elements and relative sizes is purely for illustration and not intended to be limiting to the use of the separator in practice. Well (500) is formed by wellbore (503) lined with casing (524), which contains a well-string that includes tubing (523), separator (501) and pump (502), shown here as an ESP, though any other type of artificial lift system may be used. Well fluids with entrained gasses (520) collect in the lower portion of the well bore and enter sand separator (504) through slots (505). Fin (506) causes the well fluid to spin to assist in removing any sand from the mixture. The de-sanded fluid then enters conduit (507) and flows up to gas separator (501) while the sand falls into mud joint (521).

Separator (501) operates as described with reference to FIGS. 2-4 with the gas entrained fluid flowing around auger (508) and the gasses entering inner conduit (509). The gasses are conveyed through conduit (509) and to vent line (510) where the gasses can be vented (518) directly into the wellbore above the pump intake. In other embodiments, the gas vent line can travel up the well bore to the surface. The degassed fluid (522) flows up to the other side of packer (514) where it enters pump (502) at pump intake (513) and is carried to the surface.

Figure 6:
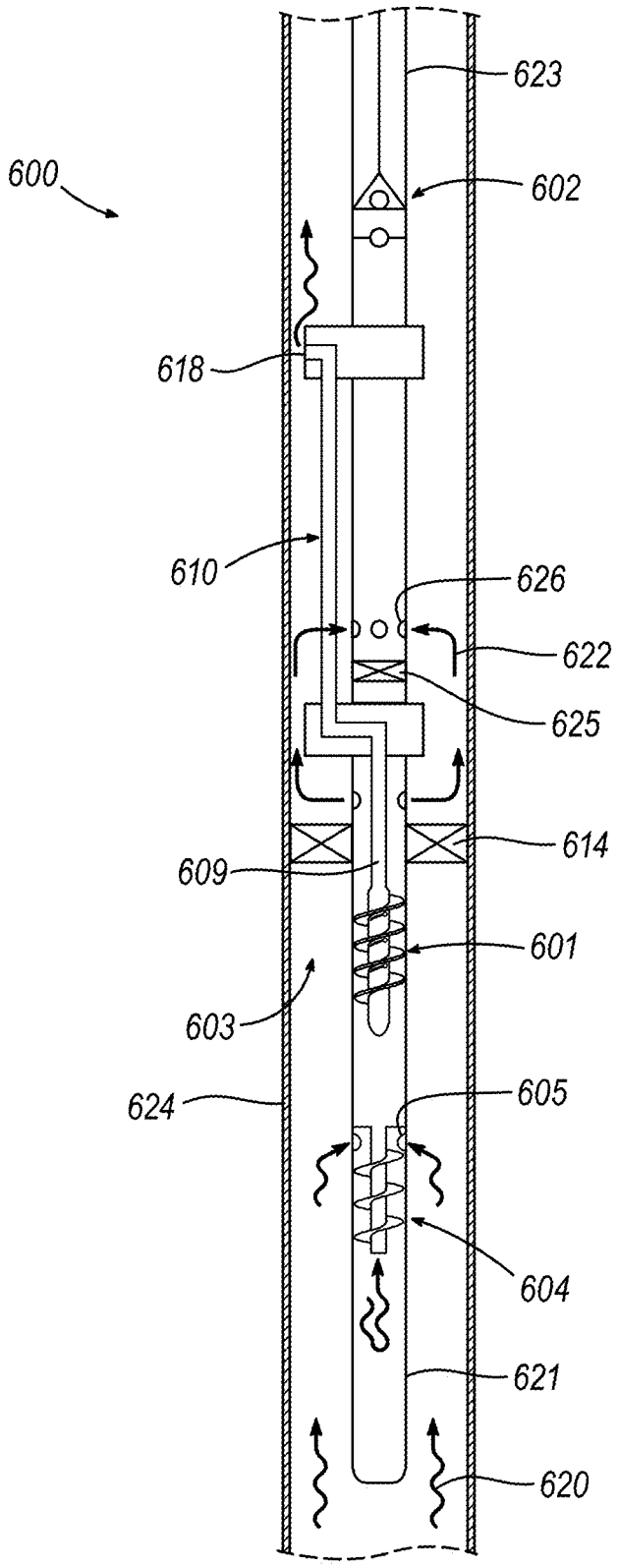
FIG. 6 depicts a side view of an exemplary well-string arrangement in a well-bore employing a rod pumping system.

Referring now to FIG. 6, another example of separator in a well environment according to the concepts described herein is shown using a rod or similar type of pump in place of the ESP of FIG. 5. As in FIG. 5, well (600) is formed by wellbore (603) lined with casing (624). Tubing (623) includes separator (601) and rod pump (602). Well fluids with entrained gasses (620) collect in the lower portion of the well bore and enter sand separator (604) through intakes (605). The gassy fluid (620) is prevented from rising up the well bore by packer (614) which forces the fluid into intakes (605). The helical sand bypass (604) causes the well fluid to spin as it travels down through the sand bypass to assist in removing any sand from the mixture. The de-sanded fluid then enters gas separator (601) while the sand falls into mud joint (621).

Separator (601) operates as described with reference to FIGS. 2-5 with the gas entrained fluid flowing around the auger and the gasses entering inner conduit (609). The gasses are conveyed through conduit (609) and to vent line (610) where the gasses can be vented (618) directly into the wellbore above the pump intake. The degassed fluid (622) is blocked by block (625) which forces the degassed fluid back into the well bore adjacent pump intake (626) flows up the tubing (623) where it enters the pump (602) and is pumped to the surface.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A separator for use within a well bore, the separator comprising:

an outer tube defining an outer conduit extending from a lower end to an upper end of the outer tube; and an auger comprising:

an inner tube positioned concentrically within the outer tube, wherein the inner tube defines an inner conduit extending from a lower end to an upper end of the inner tube, wherein the lower end of the inner tube includes a cap, wherein the inner tube includes one or more openings, wherein the one or more openings in the inner tube are connected to one or more corresponding slots in the inner tube extending along a circumference of the inner tube along a path of the auger; and an auger blade extending between the inner tube and the outer tube, the auger defining a pathway between the outer tube and the inner tube.

2. The separator of claim 1, wherein the one or more openings of the inner tube are adjacent to a lower surface of the auger blade.

3. The separator of claim 1, wherein the lower end of the outer tube is open to receive a fluid mixture including gas into the outer conduit allowing the fluid mixture to flow from the lower end of the outer conduit along the pathway defined by the auger, and wherein the one or more openings in the inner tube allow the gas from the fluid mixture to enter the inner conduit.

4. The separator of claim 1, wherein a bottom end of the separator is connected to a packer assembly.

5. The separator of claim 1, wherein a gas free fluid flows up in the outer conduit to an artificial lift mechanism.

6. A separator assembly for use within a well bore, the separator assembly comprising:

a casing defining an annulus;

a packer disposed within the annulus of the casing, wherein a portion of the packer is positioned adjacent to an interior surface of the casing; and a separator disposed within the annulus of the casing above the packer, wherein the separator comprises:

an outer tube defining an outer conduit extending from a lower end to an upper end of the outer tube, the outer tube comprising at least one slot configured to receive well fluids from the annulus into the outer tube;

an inner tube positioned concentrically within the outer tube, wherein the inner tube defines an inner conduit extending from a lower end to an upper end of the inner tube, wherein the lower end of the inner tube includes a cap, and wherein the inner tube includes one or more openings connected to one or more corresponding slots in the inner tube; and a helical auger blade extending between the inner tube and the outer tube, the helical auger blade defining a pathway between the outer tube and the inner tube.

7. The separator of claim 6, wherein the one or more openings are adjacent to a lower surface of the helical auger blade.

8. The separator of claim 6, wherein the lower end of the outer tube is open to receive a fluid mixture including gas into the outer conduit allowing the fluid mixture to flow from the lower end of the outer conduit along the pathway defined by the helical auger blade, and wherein the one or more openings in the inner tube allow the gas from the fluid mixture to enter the inner conduit.

9. The separator of claim 6, wherein a bottom end of the separator is connected to a packer assembly.

10. The separator of claim 6, wherein a gas free fluid flows up in the outer conduit to an artificial lift mechanism.

11. A method for separating gas from fluid in a production stream in a well, the method comprising:

receiving the production stream into an outer tube of a separator;

causing the production stream to flow through an outer conduit defined by the outer tube, an auger disposed between the outer tube and an inner tube, the auger comprising an auger blade, wherein the inner tube includes one or more openings adjacent to a bottom surface of the auger blade such that gas in the production stream can flow into an inner conduit in the inner tube, wherein the one or more openings are connected to one or more corresponding slots in the inner tube extending along a circumference of the inner tube along a path of the auger; and directing a separated fluid of the production stream in the outer conduit to an artificial lift mechanism above the separator.

12. The method of claim 11, wherein the one or more openings are adjacent to a lower surface of the auger blade.

13. The method of claim 11, wherein a lower end of the outer tube is open to receive a fluid mixture including gas in the outer conduit allowing the fluid mixture to flow from the lower end of the outer conduit along the pathway defined by the helical auger, and wherein the one or more openings in the inner tube allow the gas from the fluid mixture to enter the inner conduit.

14. The method of claim 11, wherein a bottom end of the separator is connected to a packer assembly.

* * * * *